US012564255B2

(12) United States Patent
Yeheskel et al.

(10) Patent No.: US 12,564,255 B2
(45) Date of Patent: Mar. 3, 2026

(54) HAIR STYLING TEMPLATE

(71) Applicant: Quality Time Solutions, Inc., Cold Spring Harbor, NY (US)

(72) Inventors: Nissim Yeheskel, Cold Spring Harbor, NY (US); Menashe Yeheskel-Baum, Yavne (IL)

(73) Assignee: QUALITY TIME SOLUTIONS, INC., Cold Spring Harbor, NY (US)

( * ) Notice: Subject to any disclaimer, the term of this patent is extended or adjusted under 35 U.S.C. 154(b) by 154 days.

(21) Appl. No.: 18/430,776

(22) Filed: Feb. 2, 2024

(65) Prior Publication Data

US 2025/0098835 A1 Mar. 27, 2025

Related U.S. Application Data

(63) Continuation-in-part of application No. 29/903,588, filed on Sep. 26, 2023, now Pat. No. Des. 1,106,576.

(51) Int. Cl.
*A45D 24/36* (2006.01)

(52) U.S. Cl.
CPC ..... *A45D 24/36* (2013.01)

(58) Field of Classification Search
CPC ..... A45D 24/00; A45D 24/02; A45D 24/10; A45D 24/34; A45D 24/36; A45D 26/00; A45D 26/0004; A45D 26/0009; A45D 26/0014; A45D 26/0019; A45D 26/0023; A45D 26/0028; A45D 26/0033; A45D 26/0038; A45D 26/0042; A45D 26/0052; A45D 26/0061; A45D 27/00; A45D 27/38; A45D 27/42; B26B 21/00; B26B 21/12; B26B 21/40; B26B 21/42; B26B 25/007
See application file for complete search history.

(56) References Cited

U.S. PATENT DOCUMENTS

| | | | | | |
|---|---|---|---|---|---|
| 1,517,166 | A * | 11/1924 | Powers | A45D 24/36 | 132/214 |
| 2,749,922 | A * | 6/1956 | Daniel et al. | A45D 24/36 | 132/214 |
| 3,407,823 | A * | 10/1968 | Selvaggio | A45D 24/36 | 132/214 |
| 3,858,589 | A * | 1/1975 | Geiger | A45D 24/36 | 132/214 |
| 4,977,672 | A * | 12/1990 | Hamilton | A45D 24/36 | 132/214 |
| D428,670 | S * | 7/2000 | Tsai | D28/40 | |
| 6,112,425 | A * | 9/2000 | Nelson | G09B 11/04 | D10/64 |
| 7,246,447 | B2 * | 7/2007 | Demko | A45D 19/012 | 132/214 |
| D768,332 | S * | 10/2016 | Esnard | D28/44.2 | |
| D833,073 | S * | 11/2018 | Ma | D28/44.2 | |
| 11,583,054 | B1 | 2/2023 | Kafri | | |
| D992,817 | S * | 7/2023 | Yeheskel | D28/44.2 | |
| 2005/0000536 | A1 * | 1/2005 | Notorio | A45D 24/36 | 30/32 |

(Continued)

*Primary Examiner* — Rachel R Steitz
*Assistant Examiner* — Karim Asqiriba
(74) *Attorney, Agent, or Firm* — Dilworth & Barrese, LLP.; Michael J. Musella, Esq.

(57) ABSTRACT

A template for improving hair style, has a series of ridges around an outer periphery thereof, and is preferably in the shape of an asymmetric quatrefoil, with two opposite points on the quatrefoil each having a protrusion to facilitate aligning for hair styling.

13 Claims, 6 Drawing Sheets

(56) References Cited

U.S. PATENT DOCUMENTS

| | | | | |
|---|---|---|---|---|
| 2012/0234341 | A1* | 9/2012 | Kingery | A45D 27/42<br>132/214 |
| 2013/0213429 | A1* | 8/2013 | Allen | A45D 24/36<br>132/214 |
| 2016/0255938 | A1* | 9/2016 | Brunett | A45D 24/36 |
| 2017/0035178 | A1* | 2/2017 | Alvarez | A45D 27/42 |
| 2018/0332949 | A1* | 11/2018 | Soare | A45D 44/00 |
| 2019/0053599 | A1* | 2/2019 | Villa | A45D 44/12 |
| 2019/0223573 | A1* | 7/2019 | Maroun | A45D 44/00 |
| 2021/0015235 | A1* | 1/2021 | Lilly, Jr. | A45D 40/30 |

* cited by examiner

HAIR STYLING TEMPLATE

BACKGROUND OF THE INVENTION

The present invention is directed to an improved template for styling hair and e.g., trim a facial beard. More particularly, the present invention is directed to a template for hair and beard styling improving secure, accurate hair and beard styling and trimming in reliable fashion.

Templates for trimming hair and beards are conventionally available, with do-it-yourself styling templates having come into vogue to eliminate need to seek out a professional barber or hair stylist. Basically, the user holds the template against the cheek and simultaneously trims the exposed beard with a trimmer, razor, or other hair grooming tools. However, such do-it-yourself guides have not been reliable for trimming hair such as facial beards. It has been difficult to grip and hold such template in place, e.g., against the cheek, while at the same time trimming the beard. Ensuring symmetrical styling of beards on both cheeks of the face has been problematic. Previously-known templates required through-holes which complicated trimming and adversely impacted accuracy and reliability in trimming.

SUMMARY OF THE INVENTION

Accordingly, it is an object of the present invention to improve trimming and styling of hair, especially facial beards.

It is also an object of the present invention to improve accuracy and reliably in such hair and beard trimming, especially by a single individual.

It is another object of the present invention to improve gripping of a hair or beard styling template by such individual while styling hair or a beard.

These and other objects are attained by the present invention which is directed to a hair styling template which is multifaceted, e.g., in the shape of quatrefoil, with two opposite points on the quatrefoil each having a protrusion to facilitate aligning for hair styling. The quatrefoil is preferably asymmetric. Additionally, the hair styling template preferably has a series of ridges extending around the outer periphery thereof, improving aligning and securing against a cheek for trimming a beard. These ridges facilitate anchoring and stabilizing the guide against the cheek and beard for trimming. Furthermore, the hair being trimmed is caught between these ridges and therefore cannot move during trimming, enhancing accuracy and reliability in trimming, and contouring the beard as desired.

The present invention is also easy to manufacture, e.g., from a plastic mold, and requires a minimal number of features, such a through-hole extending through the template. The entire template can be molded in a single molding step, without carrying out any other manufacturing steps. For example, the ridges and overall nonslip gripping surfaces on both sides of the template, are simultaneously molded in a single step.

BRIEF DESCRIPTION OF THE DRAWINGS

The present invention will be described in greater detail with reference to the accompanying drawings, in which.

DESCRIPTION OF THE PREFERRED EMBODIMENTS

Figure 1:
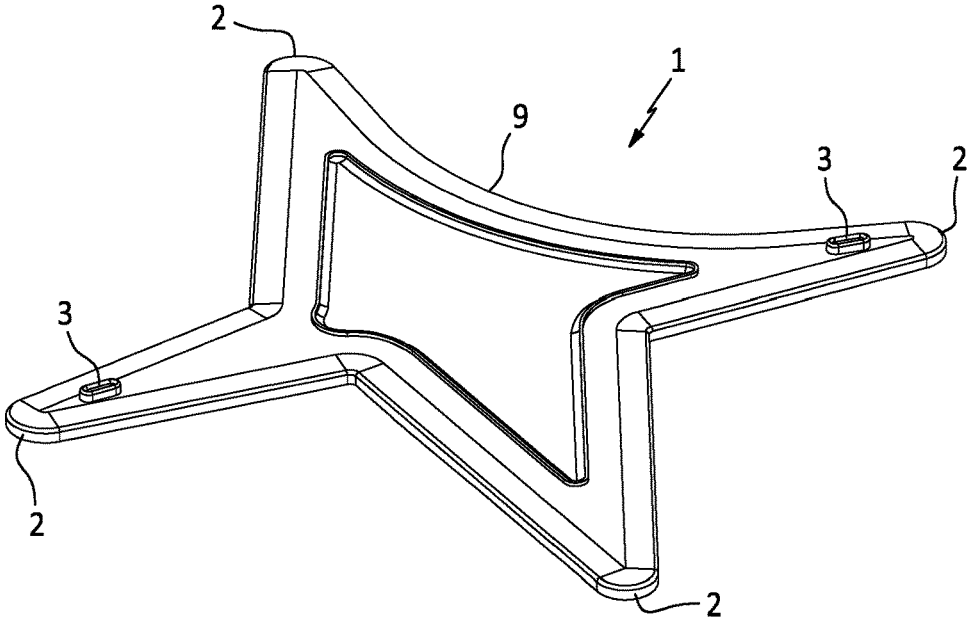
FIG. 1 is a top right perspective view of the hair styling template according to the present invention.
Figure 2:
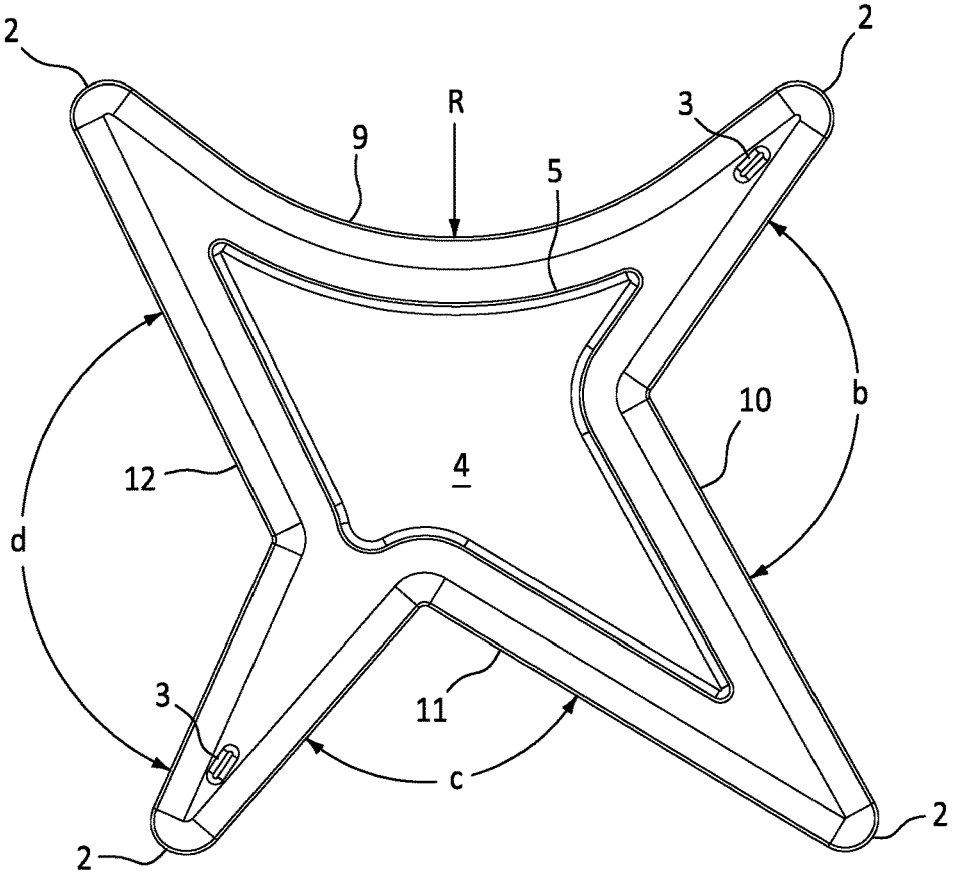
FIG. 2 is a top plan view of the hair styling template of FIG. 1, the bottom plan view being a substantial mirror image thereof.
Figure 3:
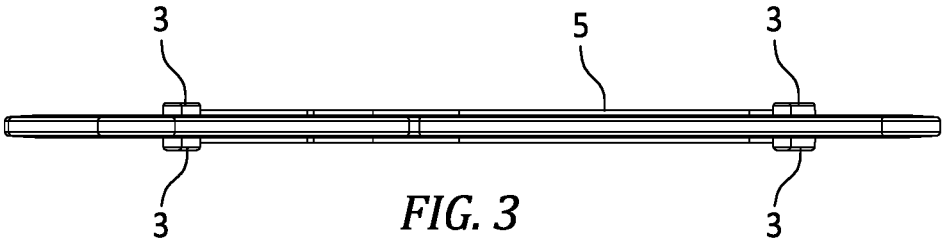
FIG. 3 is a front elevational view of the hair styling template of FIGS. 1 and 2.
Figure 4:
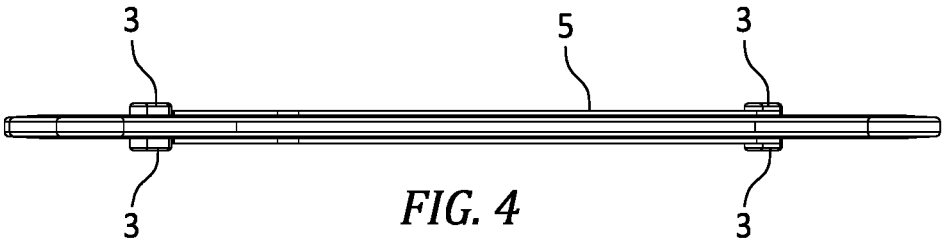
FIG. 4 is a rear elevational view of the hair styling template of FIGS. 1-3.
Figure 5:
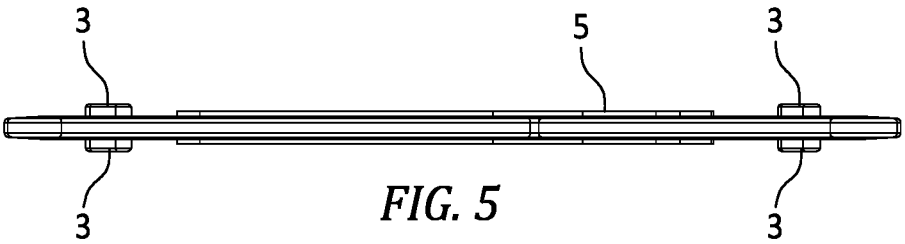
FIG. 5 is a right side elevational view of the hair styling template of FIGS. 1-4.
Figure 6:
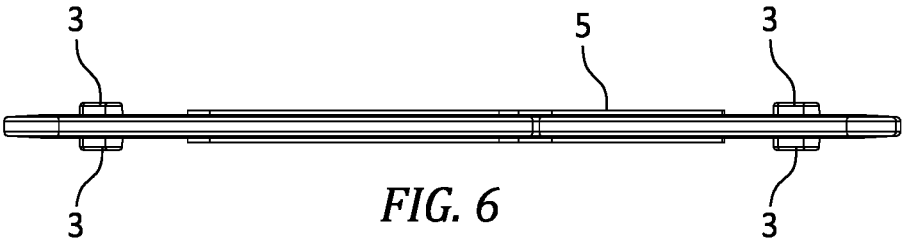
FIG. 6 is a left side elevational view of the hair styling template of FIGS. 1-5.

Referring to the drawings, as shown in FIGS. 1-6, the present invention is directed to a hair styling template 1 substantially in the shape of an asymmetric quatrefoil having four points. One edge 9 of a periphery between two of the points 2 is curved, while the remaining edges 10-12 form sharp obtuse angles. On two opposite points 2, there is a hollow oblong-shaped protrusion 3 to facilitate gripping and aligning the template 1, e.g., against the face or head, for hair or beard trimming as illustrated, e.g., in FIG. 14.

The apices of the respective angles b, c, and d are asymmetrically situated within each respective peripheral side 10-12 as shown. As shown, e.g., in FIGS. 1, 2, 7, 8, and 13, the apices of angles c and d sit across intermediate point 2 from one another, the apices of angles b and c sit across intermediate point 2 from one another, but the apices of angles b and d are staggered or offset from one another.

Figure 7:
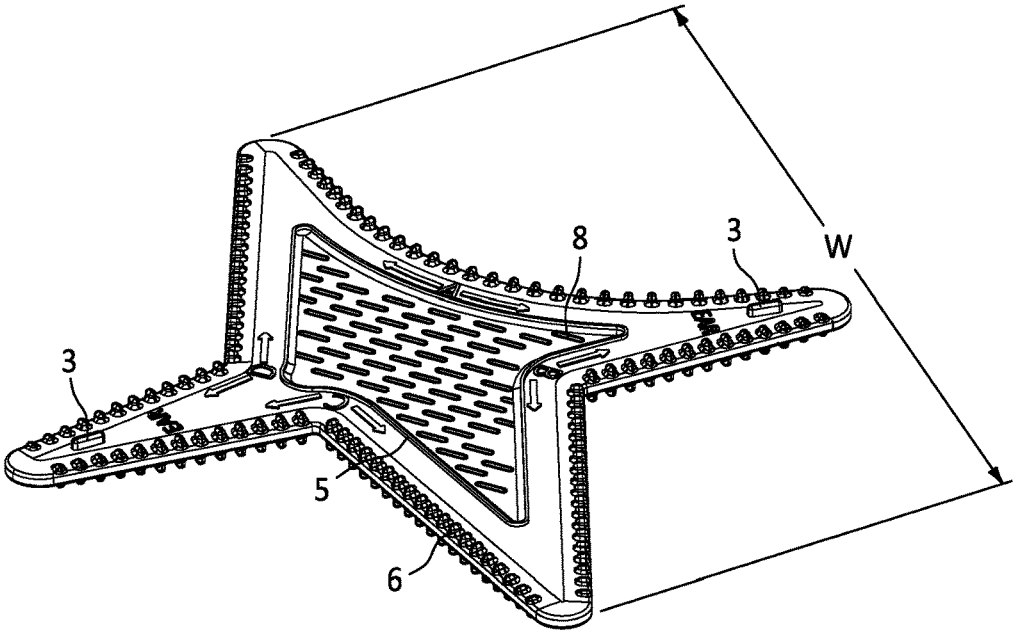
FIG. 7 is a top right perspective view of another embodiment of the hair styling template according to the present invention.
Figure 8:
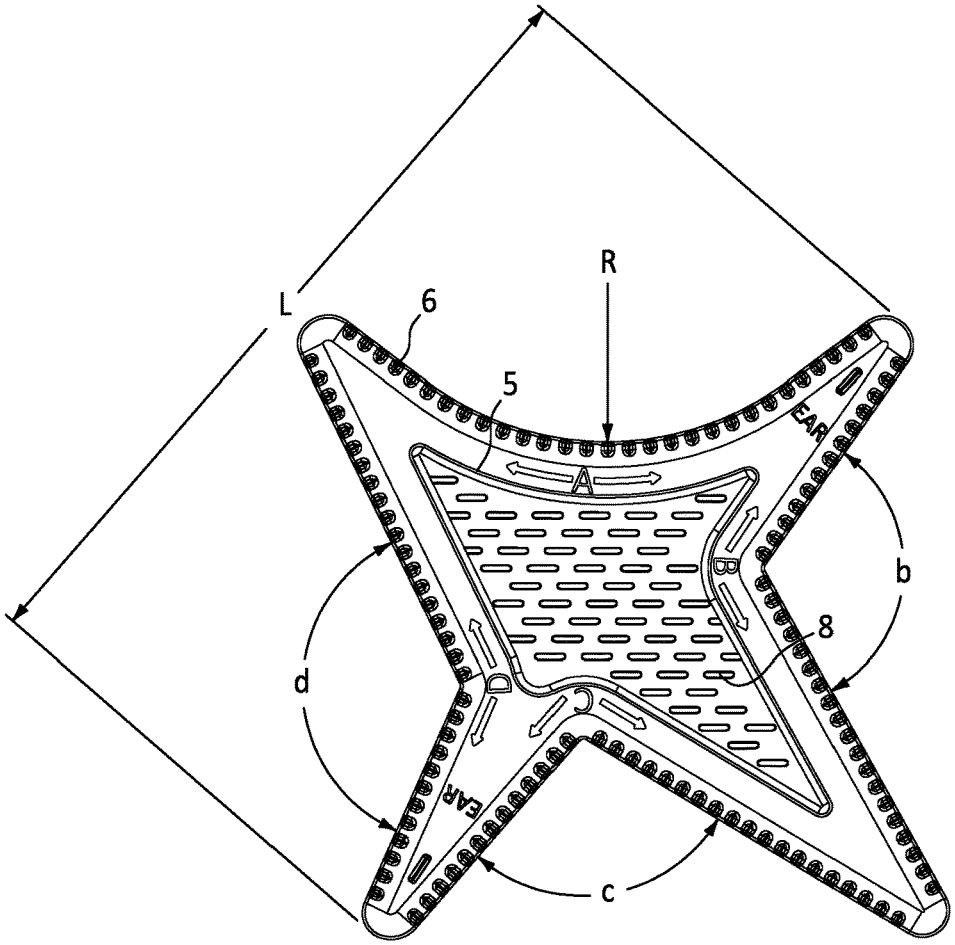
FIG. 8 is a top plan view of the hair styling template of FIG. 7, the bottom plan view being a substantial mirror image thereof.
Figure 9:
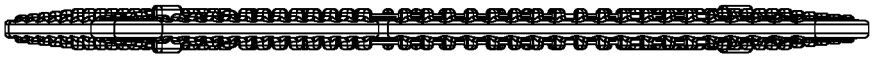
FIG. 9 is a front elevational view of the hair styling template of FIGS. 7 and 8.
Figure 10:
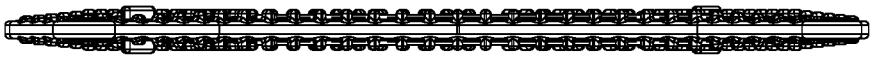
FIG. 10 is a rear elevational view of the hair styling template of FIGS. 7-9.
Figure 11:
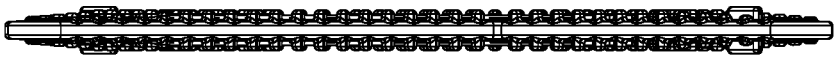
FIG. 11 is a right side elevational view of the hair styling template of FIGS. 7-10.
Figure 12:
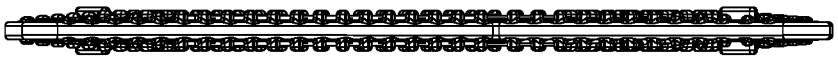
FIG. 12 is a left side elevational view of the hair styling template of FIGS. 7-11.

The hair styling template 1 has an internal recessed portion 4 bounded by a raised wall 5, also roughly in the shape of an asymmetric quatrefoil. The radius of curvature of the edge 9 is about 1.5 to about 3.5 inches, most preferably about 2 and 3/4 inches, while angle b is about 105 to about 130 degrees, preferably about 116°, angle c is about 91 to about 115 degrees, preferably about 100°, and angle d is about 110 to about 170 degrees, preferably about 130°. Referring to FIGS. 7 and 8, length L between the tips of the points 2 containing protrusions 3 is approximately 3 to about 9 inches, preferably about 7½ inches, while the width W between the tips of the two other points 2 is approximately 4 to about 11 inches, preferably about 8 inches.

The embodiment illustrated in FIGS. 7-12 is analogous to the embodiment illustrated in FIGS. 1-6, but contains the following additional features. The internal recessed area 4 additionally contains raised oblong-shaped bumps or protrusions 8 to facilitate gripping. These bumps or protrusions 8 within the recessed area 4 on both opposite surfaces of the template 1, not only facilitate gripping, but when placed against the face or beard (as shown, e.g., in FIG. 14), the template 1 and the hand holding the template 1 will not slip because the rough surfaces defined by the bumps 8 form nonslip surfaces.

Figure 14:
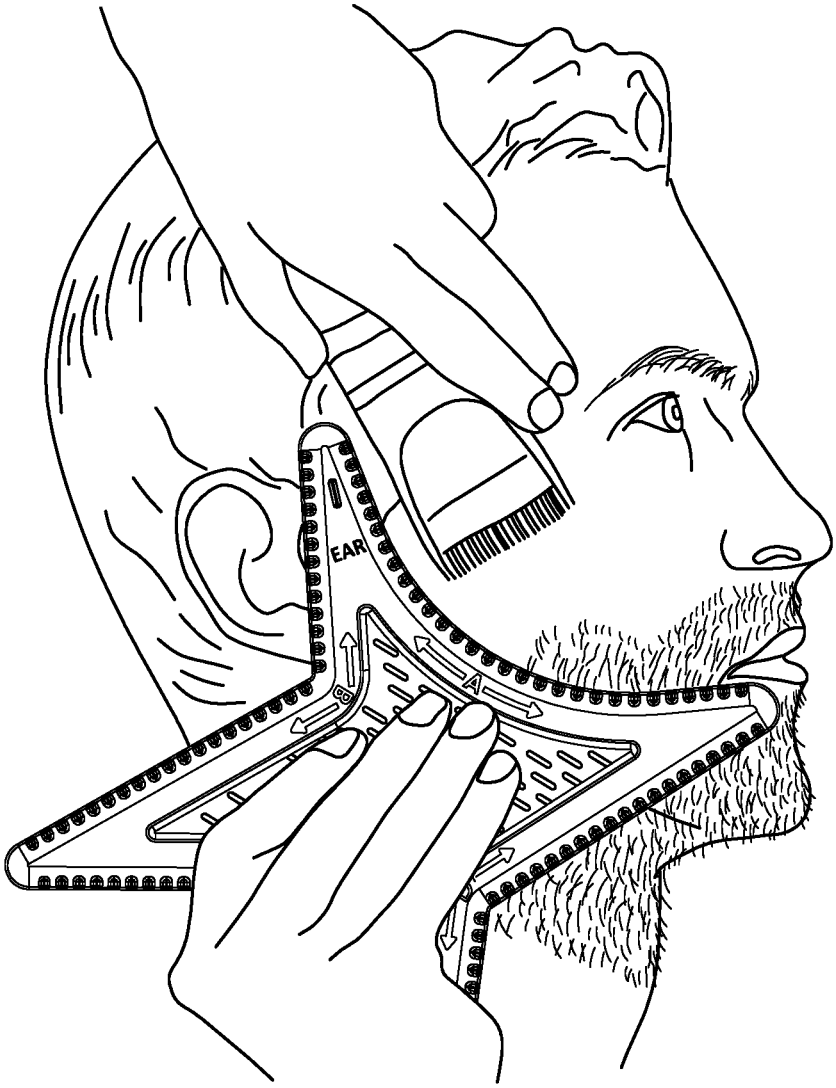

Furthermore, the outer periphery 9-12 of the template 1 contains ridges 6 between all points 2 of the template 1. As shown, e.g., in the perspective view of FIG. 7, the ridges 6 run along both sides of the periphery 9-12. These ridges 6 serve as anchors to facilitate holding the template 1 against the face while trimming a beard (FIG. 14). Additionally, these ridges 6 can serve as bristles of a brush or teeth of a comb, when the template 1 is used, e.g., for brushing or combing hair.

The embodiment illustrated in FIGS. 7-12 also contains an instructional guide for trimming a facial beard in the area between the peripheral edges 6 and raised wall 5. As shown in FIGS. 7 and 8, the guide contains the labeling "EAR" adjacent the points 2 containing the respective oblong shaped protrusions 3, so the template 1 can be held against the head in front of an ear of a user during trimming, as shown in FIG. 14. Double-headed arrows A, B, C, and D denote trimming edges for effecting a certain trimmed look of a beard on the face, and four main shapes for trimming a facial beard. This labeling and guide helps ensure the beard on the left and right cheeks of the face is symmetrically trimmed. In this regard, the template 1 can be flipped over to trim the beard on the opposite cheek of the face, because the reverse side of the template 1 is a mirror image also including the labeling and trimming guide.

Figure 13:
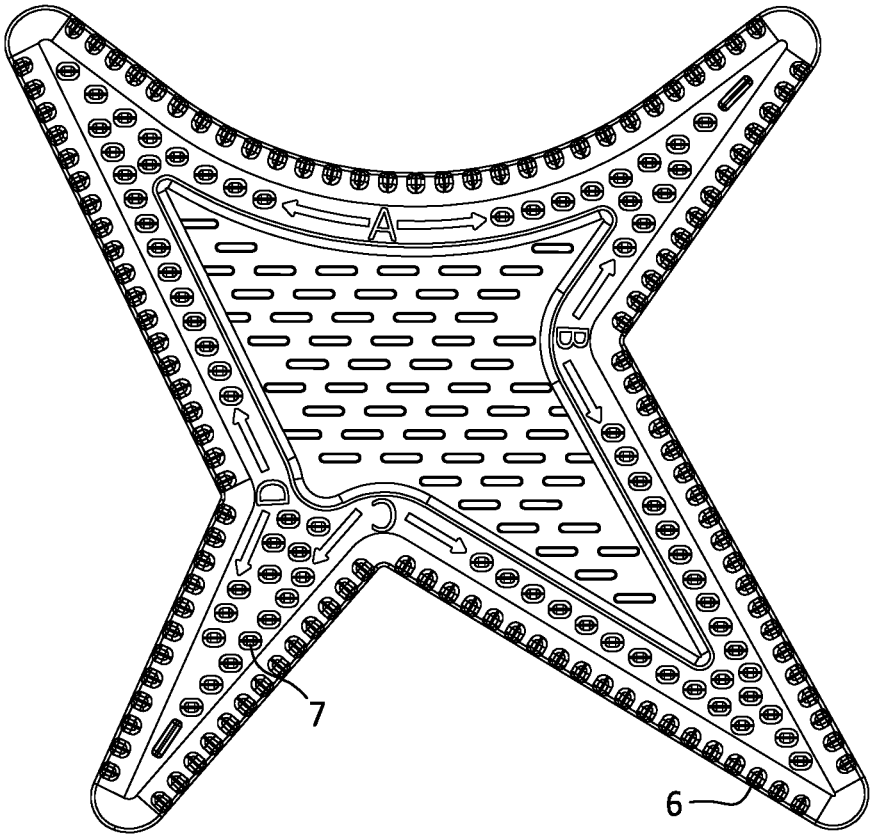
FIG. 13 is a top plan view of another embodiment of the hair styling template according to the present invention, and FIG. 14 schematically illustrates the hair styling template of FIGS. 7-12 in use.

The embodiment illustrated in FIG. 13 additionally contains ridges 7 in the area between the raised wall 5 and outer periphery 9-12 containing the ridges 6 along the edge thereof. These additional ridges improve gripping, allowing the template 1 to be additionally used as a brush against a beard, along with providing additional anchoring against the beard from trimming. Furthermore, such template can also be used as a brush or comb to brush or comb the beard before trimming. For example, the beard can be brushed or combed by placing the template 1 flat against the beard and face, and moving the guide along the beard to facilitate aligning the whiskers in the same direction, thereby enhancing reliable, accurate contouring of the beard when the guide is subsequently held in stationary position against the cheek while the razor is used to trim the beard as desired.

The hair styling template can be manufactured from hard plastic, soft plastic, metal or wood. The various angles and curves between the respective points 2 allow a user to fashion a particular look of a trimmed beard. As shown in FIG. 14, the internal recessed area 4 containing the oblong-shaped protrusions 6 can be gripped and pressed against a cheek of the face, to securely hold the template 1 in place while trimming a beard. The recessed area 4 in the center of the template 1, provides a good grip, especially with the internal protrusions 8, to improve secure non-slip gripping while trimming a beard, so the holding hand does not slip while using the template 1. As shown in FIG. 14, the template 1 is especially useful for a single individual to accurately, reliably trim their own facial beard by gripping the template 1 with one hand and holding it against the cheek, while simultaneously using a trimming razor to trim exposed portions of their beard protruding from the template 1.

The preceding description of the present invention is merely exemplary, and not intended to limit the scope thereof in any way.

What is claimed is:

1. A hair styling template, comprising:

a body having an asymmetrical star shape, said star shape having at least four points;

an outer periphery between two adjacent points defining an edge, wherein at least one edge between two points is curved and remaining edges define an angle;

additionally comprising an inner recessed portion within a surface of said hair styling template;

wherein said inner recessed portion is substantially in a shape of a star and spaced away from the outer periphery thereof; and wherein said inner recessed portion of the hair styling template is bounded by a raised wall.

2. The hair styling template of claim 1, wherein the hair styling template further comprises a series of ridges around the outer periphery thereof.

3. The hair styling template of claim 2, wherein the series of ridges extend around an entire outer periphery thereof.

4. The hair styling template of claim 3, wherein the series of ridges extend around opposite top and bottom surfaces of the hair styling template along the entire outer periphery.

5. The hair styling template of claim 1, wherein the hair styling template is multifaceted.

6. The hair styling template of claim 5, wherein the hair styling template has four points.

7. The hair styling template of claim 6, wherein two opposite points each comprise a protrusion to facilitate aligning for hair styling.

8. The hair styling template of claim 7, wherein each said protrusion is in a hollow oblong shape.

9. The hair styling template of claim 1, wherein all said angles are obtuse.

10. The hair styling template of claim 1, wherein opposite top and bottom sides of said hair styling template are symmetrical to one another.

11. The hair styling template of claim 1, wherein said inner recessed portion comprises a series of protruding bumps.

12. The hair styling template of claim 11, additionally comprising a series of ridges on a surface of said hair styling template between said outer periphery and inner recessed portion.

13. The hair styling template of claim 1, additionally comprising a plurality of ridges on the surface of the hair styling template between the raised wall and the outer periphery.

* * * * *